US009565888B2

(12) United States Patent
Joseph et al.

(10) Patent No.: US 9,565,888 B2
(45) Date of Patent: Feb. 14, 2017

(54) SHOE INSERT AND METHOD FOR USING SAME

(71) Applicant: LFRJ, LLC, West Hollywood, CA (US)

(72) Inventors: Robert Joseph, West Hollywood, CA (US); Lawrence Edward Feigen, West Hollywood, CA (US)

(73) Assignee: LFRJ, LLC, West Hillywood, CA (US)

( * ) Notice: Subject to any disclaimer, the term of this patent is extended or adjusted under 35 U.S.C. 154(b) by 838 days.

(21) Appl. No.: 13/784,716

(22) Filed: Mar. 4, 2013

(65) Prior Publication Data

US 2014/0245631 A1 Sep. 4, 2014

(51) Int. Cl.

| | |
|---|---|
| ***A43B 7/14*** | (2006.01) |
| ***A43B 17/00*** | (2006.01) |
| ***A43B 1/00*** | (2006.01) |

(52) U.S. Cl.

CPC ..... *A43B 1/0027* (2013.01); *A43B 1/0045* (2013.01); *A43B 7/141* (2013.01); *A43B 7/142* (2013.01); *A43B 7/144* (2013.01); *A43B 7/1425* (2013.01); *A43B 7/1435* (2013.01); *A43B 7/1445* (2013.01); *A43B 17/006* (2013.01)

(58) Field of Classification Search

CPC ..... A43B 1/0027; A43B 1/0045; A43B 7/141; A43B 7/142; A43B 7/1425; A43B 7/1435; A43B 7/144; A43B 7/1445; A43B 17/006

USPC ..... 36/43, 44, 145

See application file for complete search history.

(56) References Cited

U.S. PATENT DOCUMENTS

| | | | | |
|---|---|---|---|---|
| 3,825,017 | A * | 7/1974 | Scrima | A43B 7/28 36/181 |
| 4,338,734 | A * | 7/1982 | Schwartz | A43B 7/141 36/44 |
| 5,778,562 | A * | 7/1998 | Karl-Heinz | A43B 17/00 36/174 |
| 6,195,917 | B1 * | 3/2001 | Dieckhaus | A43B 7/141 36/154 |
| 6,205,685 | B1 * | 3/2001 | Kellerman | A43B 1/0072 36/160 |
| 6,280,815 | B1 * | 8/2001 | Ersfeld | A43B 7/142 36/3 B |
| 6,560,902 | B1 * | 5/2003 | Eschweiler | A43B 7/141 36/154 |
| 7,752,773 | B2 * | 7/2010 | McCarron | A43B 3/0078 36/140 |
| 7,854,075 | B2 * | 12/2010 | Kosmas | A43B 7/142 36/43 |

(Continued)

OTHER PUBLICATIONS

Declaration by Robert Joseph and Pictures/Figures 1-4 of Insoles.

*Primary Examiner* — Sharon M Prange

(74) *Attorney, Agent, or Firm* — Jeffer Mangels Butler & Mitchell LLP; Brennan C. Swain, Esq.

(57) ABSTRACT

A shoe that includes a base layer, middle layer and top layer all having a top and a bottom surface. A first portion of the bottom surface of the middle layer is adhered to the top surface of the base layer, and the bottom surface of the top layer is adhered to the top surface of the middle layer. The base layer, middle layer and top layer cooperate to define a main body portion that includes a heel cup, an arch portion and a forefoot portion. The forefoot portion includes a part of the middle layer and a part of the top layer, but not a part of the base layer.

14 Claims, 28 Drawing Sheets

(56) References Cited

U.S. PATENT DOCUMENTS

| | | | | |
|---|---|---|---|---|
| 2003/0009915 | A1* | 1/2003 | Bacon | A43B 7/142 36/44 |
| 2005/0138844 | A1* | 6/2005 | Johnson | A43B 7/142 36/44 |
| 2007/0234592 | A1* | 10/2007 | Crates | A43B 1/0045 36/44 |

* cited by examiner

SHOE INSERT AND METHOD FOR USING SAME

FIELD OF THE INVENTION

The present invention relates to a shoe insert, and more particularly to a shoe insert made of a plurality of layers.

BACKGROUND OF THE INVENTION

In general, shoe inserts or orthotics are devices used to correct an abnormal gait and to correct for optimal ambulation. Custom orthotics are typically provided by a doctor and can be expensive and cumbersome to obtain. The patient must visit the doctor, have the orthotic customized and ordered and then must return at a later time to pick up the orthotic.

Over the counter or store bought orthotics or shoe inserts are simply a general shell that gives some support or padding for the wearer when walking. Over the counter orthotics are not corrective, but are provided for comfort.

Accordingly, a need exists for an orthotic or shoe insert that provides correction to the wearer's gait or ambulation, but does not require a doctor's customization.

SUMMARY OF THE PREFERRED EMBODIMENTS

In accordance with a first aspect of the present invention there is provided a shoe that includes a base layer, middle layer and top layer all having a top and a bottom surface. A first portion of the bottom surface of the middle layer is adhered to the top surface of the base layer, and the bottom surface of the top layer is adhered to the top surface of the middle layer. The base layer, middle layer and top layer cooperate to define a main body portion that includes a heel cup, an arch portion and a forefoot portion. The forefoot portion includes a part of the middle layer and a part of the top layer, but not a part of the base layer. In a preferred embodiment, the shoe insert includes a bottom layer. The bottom surface of the base layer is adhered to the top surface of the bottom layer and a second portion of the bottom surface of the middle layer is adhered to the top surface of the bottom layer. In this embodiment, the forefoot portion includes a part of the bottom layer, a part of the middle layer and a part of the top layer, but not a part of the base layer. Preferably, the base layer is comprised of polypropylene, the middle layer is made of ethylene-vinyl acetate foam, the top layer is made of ethylene-vinyl acetate foam, and the bottom layer is made of suede.

In a preferred embodiment, the main body portion includes a border portion that extends around the base portion and that comprises a part of the bottom layer, a part of the middle layer and a part of the top layer, but not a part of the base layer. Preferably, the main body portion includes a flare portion that extends outwardly from the border portion and is adjacent the arch portion in a transverse direction. The flare portion includes a part of the bottom layer, a part of the middle layer and a part of the top layer, but not a part of the base layer. In another embodiment, the main body portion includes the flare portion, but not the border portion. In a preferred embodiment, the base layer includes a raised par (that when the insert is positioned in a shoe is adjacent a wearer's 2-4 mets. Preferably, the forefoot portion only extends to adjacent a sulcus when the insert is positioned in a shoe.

In accordance with another aspect of the present invention there is provided a method of making a shoe insert that includes the steps of providing abase layer, middle layer and top layer all having a top and a bottom surface, adhering a first portion of the bottom surface of the middle layer to the top surface of the base layer, and adhering the bottom surface of the top layer to the top surface of the middle layer. The base layer, middle layer and top layer cooperate to define a main body portion that includes a heel cup, an arch portion and a forefoot portion that includes a part of the middle layer and a part of the top layer, but not a part of the base layer. In a preferred embodiment, the method also includes the step of providing a bottom layer having a top and a bottom surface, and adhering a second portion of the bottom surface of the base layer to the top surface of the bottom layer. In this embodiment, the forefoot portion includes a part of the bottom layer, a part of the middle layer and a part of the top layer, but not a part of the base layer. Preferably, the method includes positioning the shoe insert in a shoe, walking in the shoe and forming the insert to the user's foot.

The invention, together with additional features and advantages thereof, may be best understood by reference to the following description.

Figure 1:
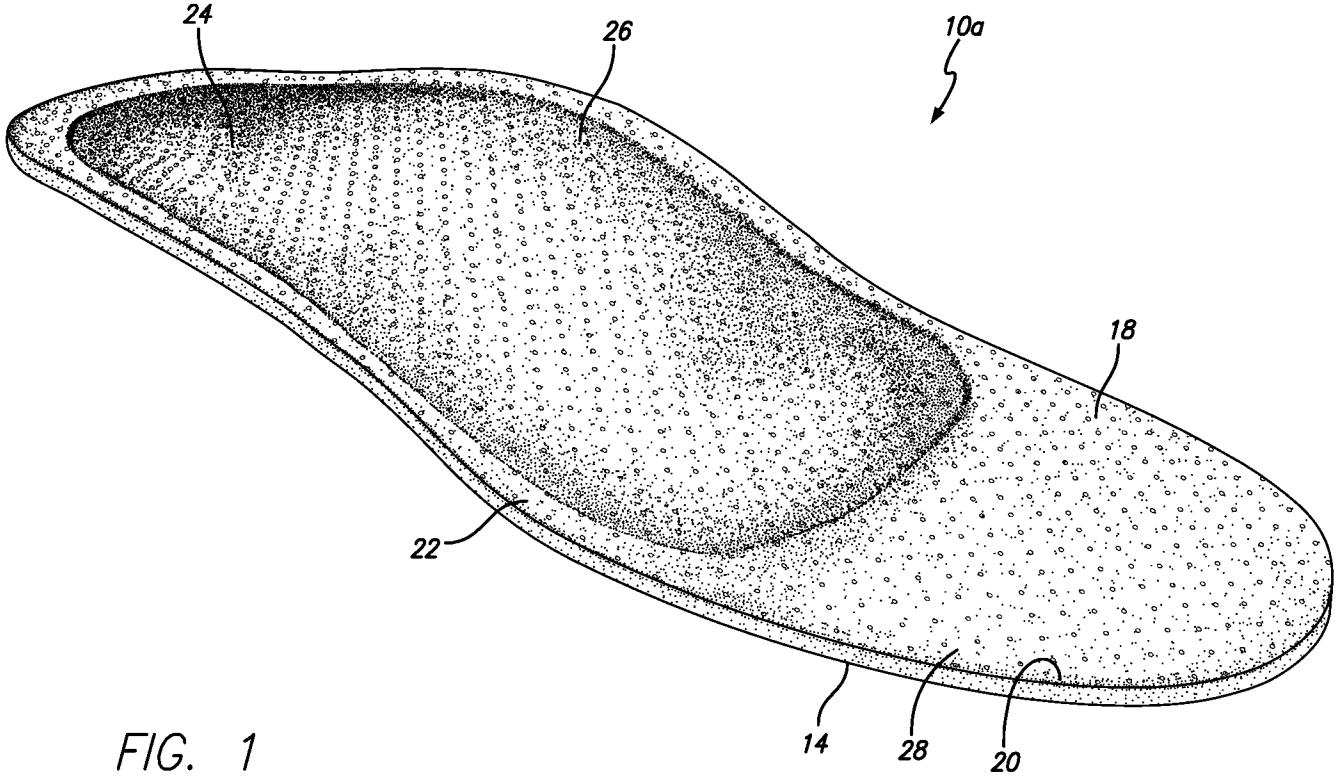
FIG. 1 is a perspective view of a shoe insert in accordance with a first preferred embodiment of the present invention.
Figure 5:
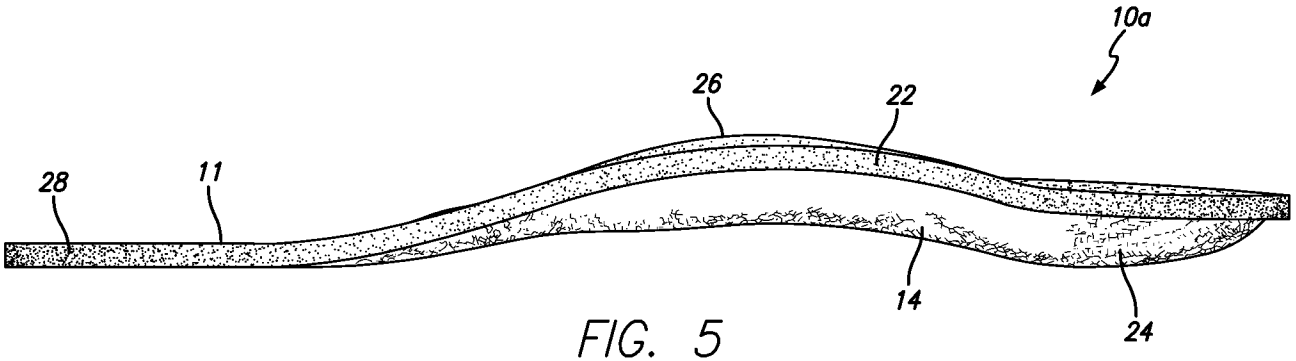
Figure 6:
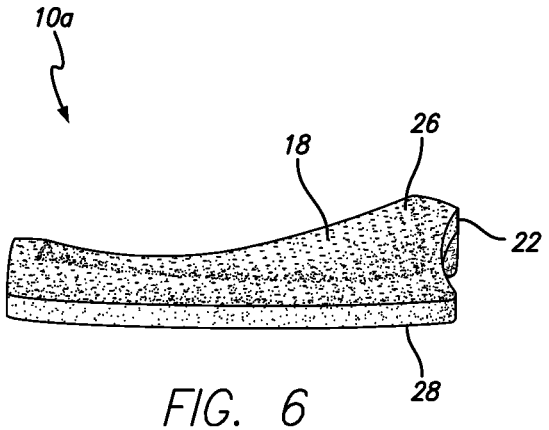
Figure 7:
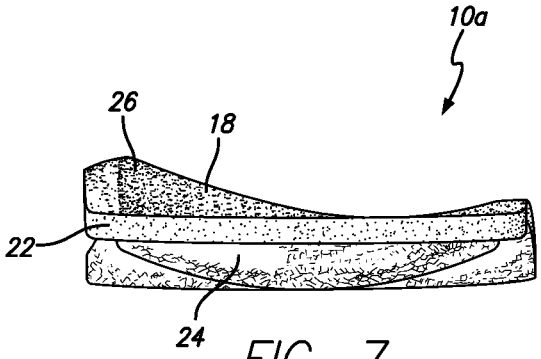
Figure 8:
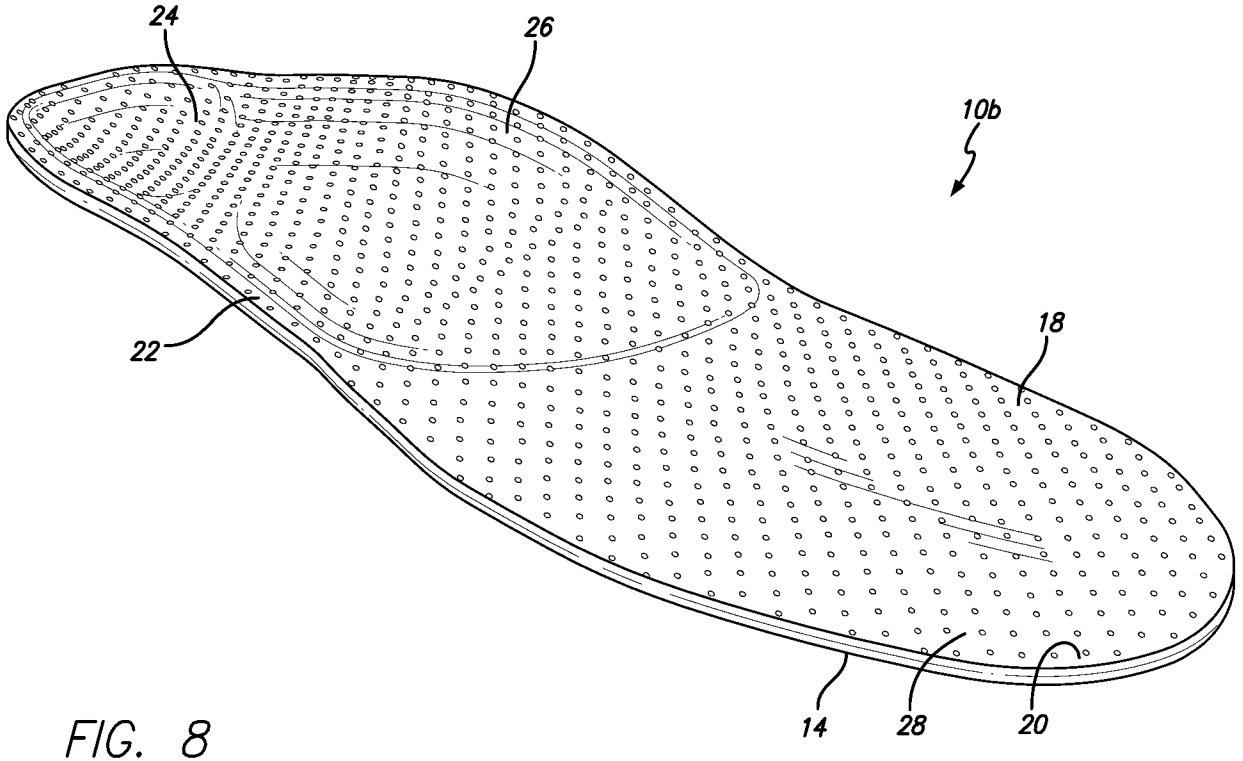
Figure 9:
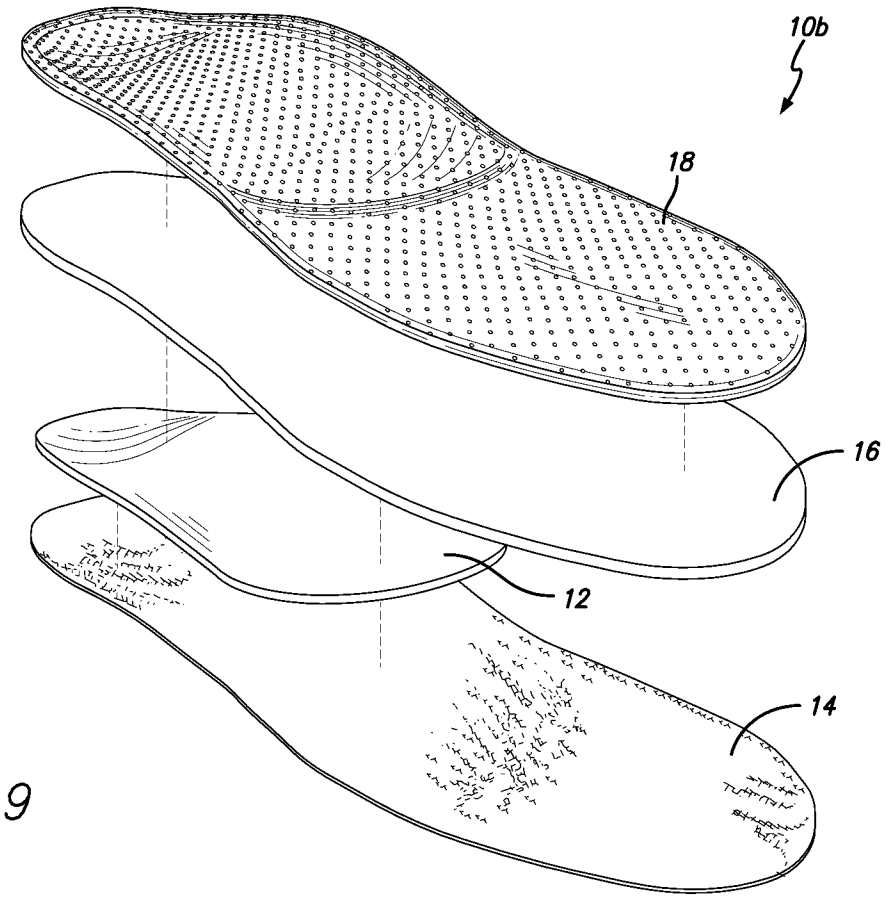
Figure 10:
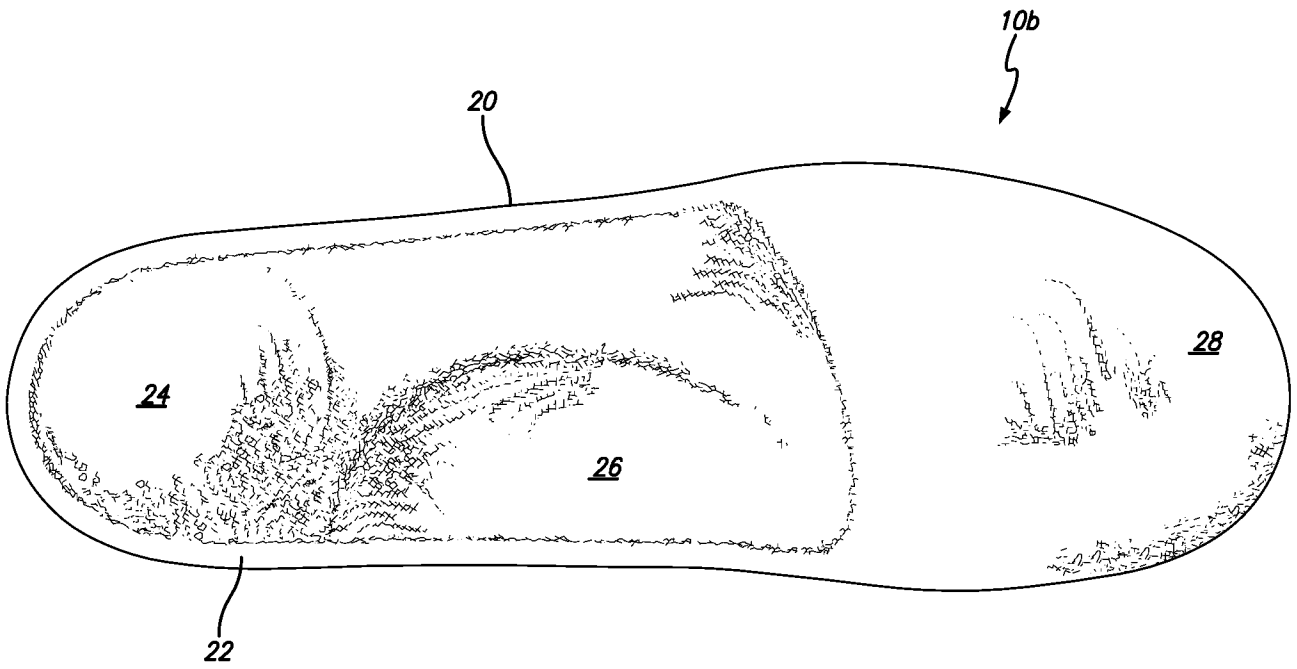
Figure 11:
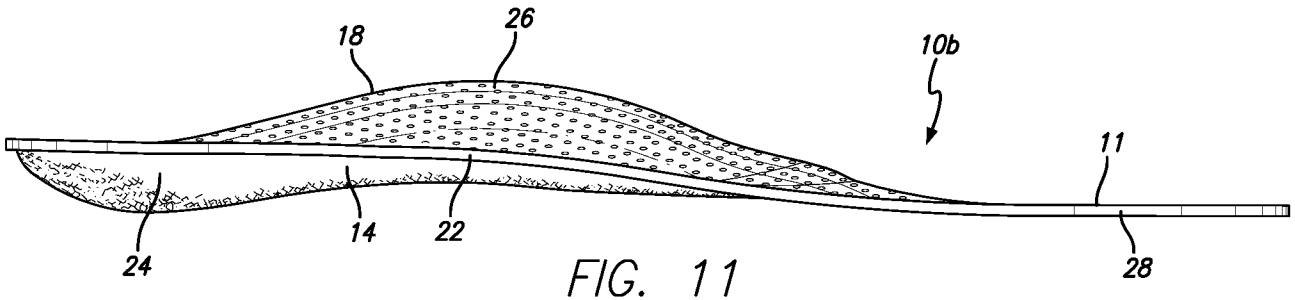
Figure 12:
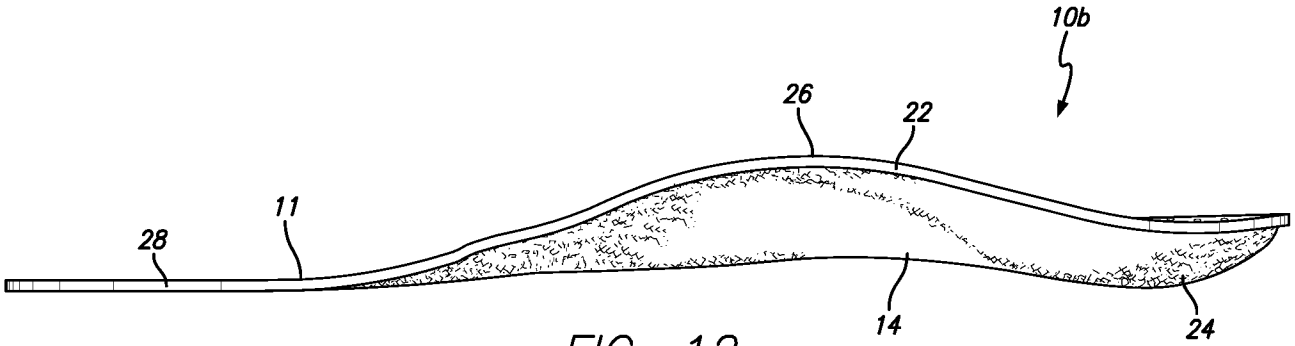
Figure 13:
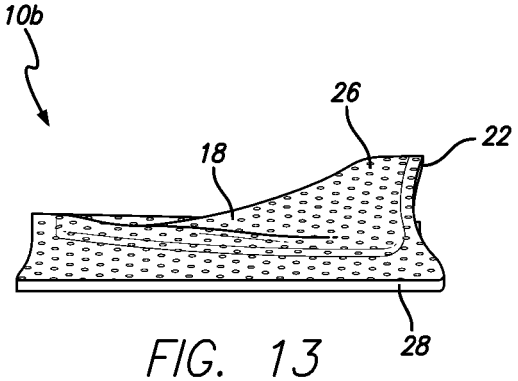
Figure 14:
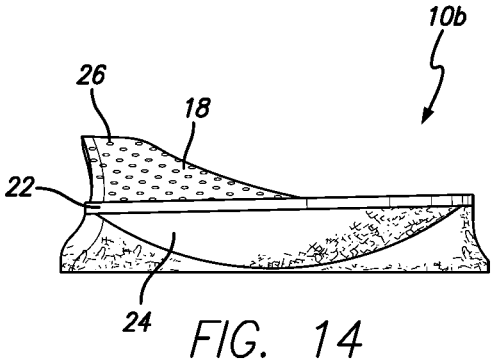
Figure 15:
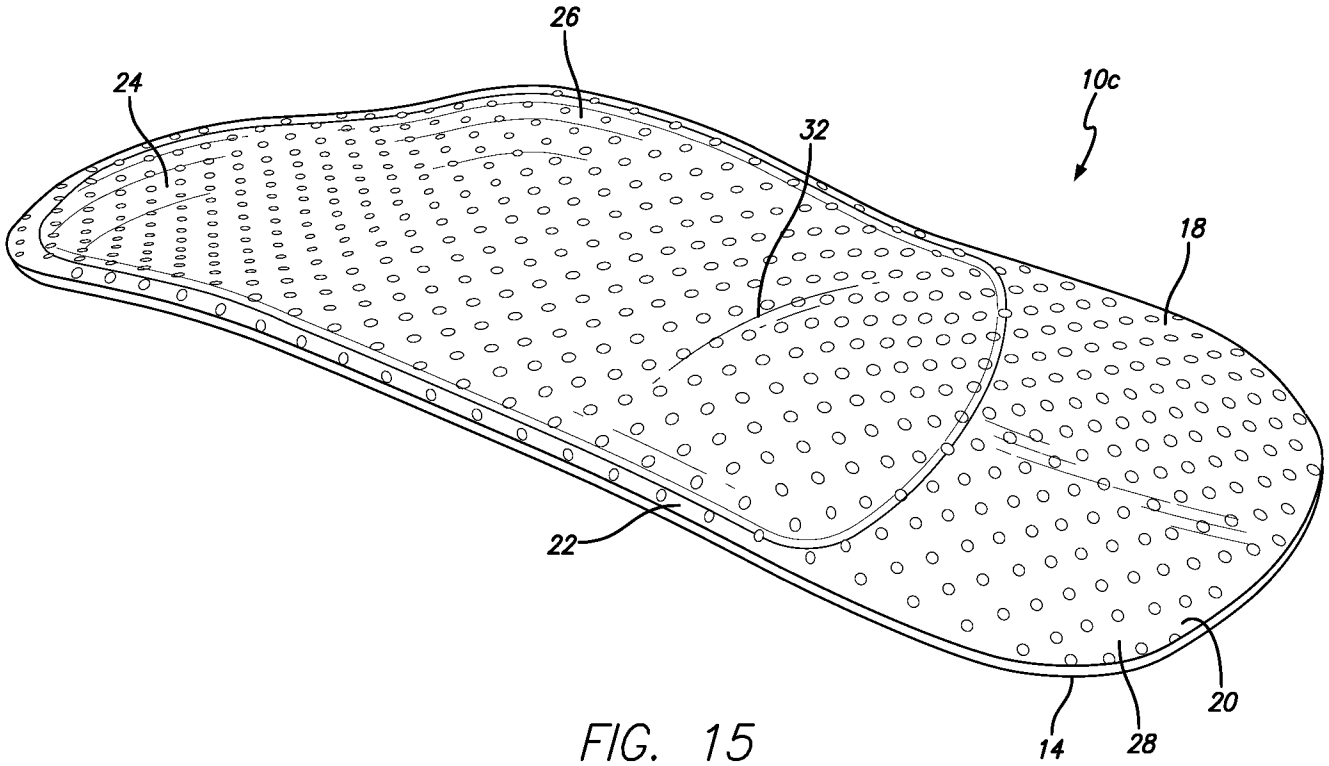
Figure 16:
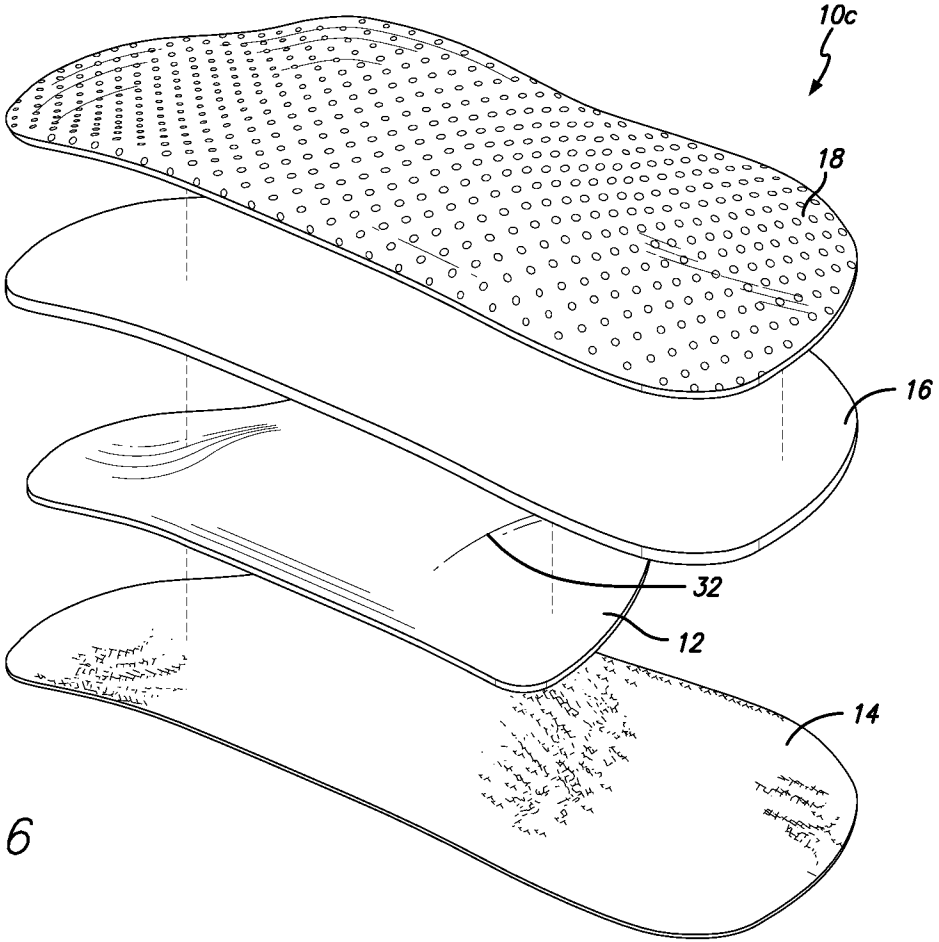
Figure 17:
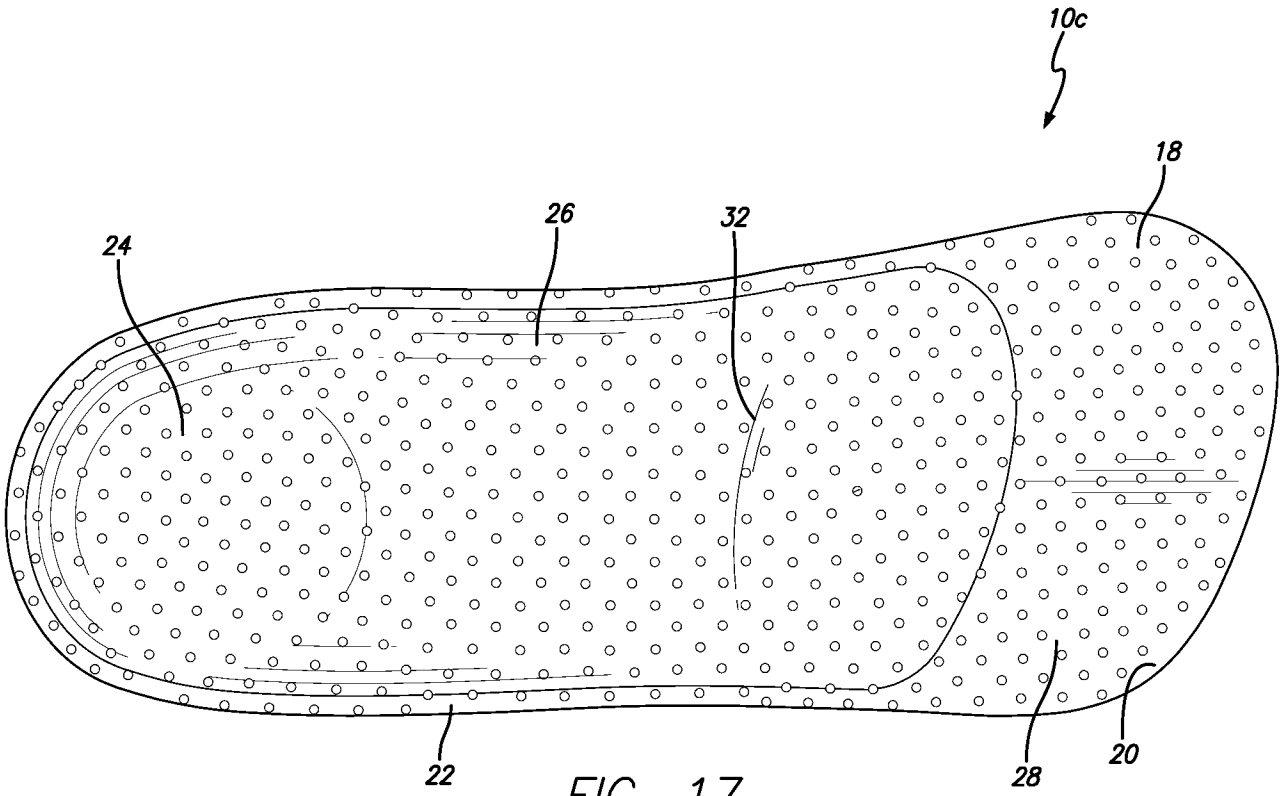
Figure 18:
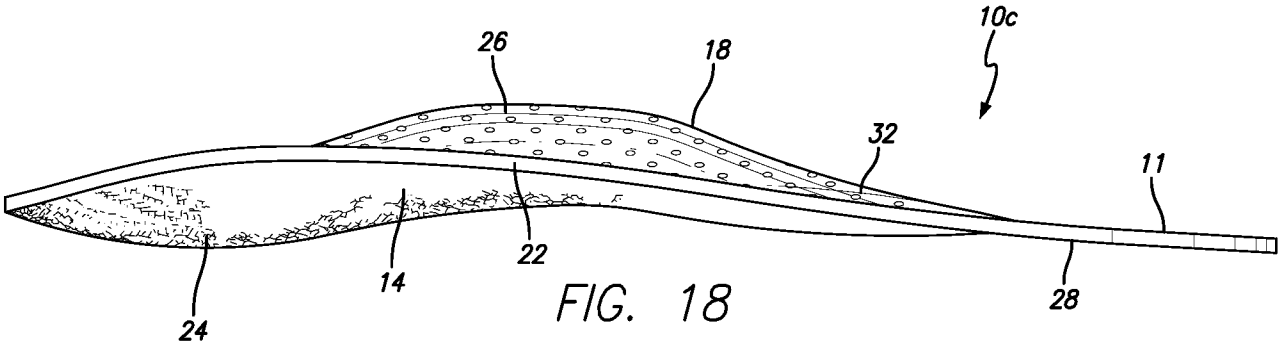
Figure 19:
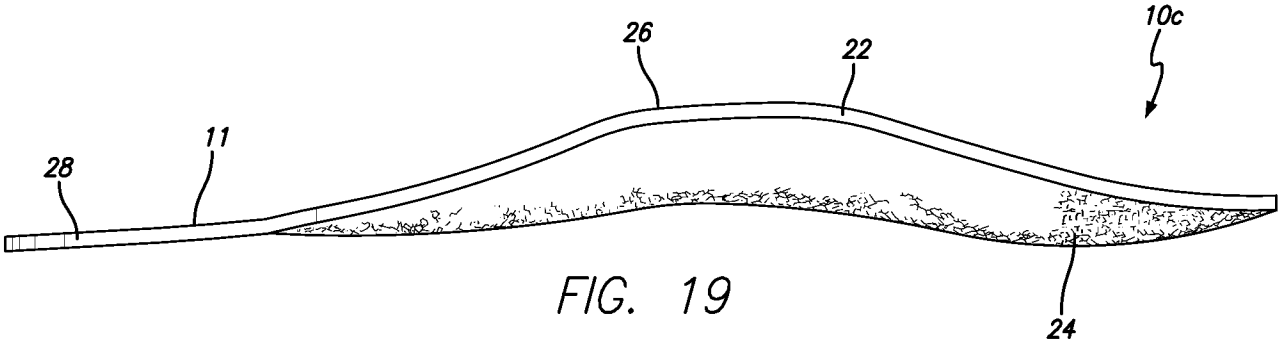
Figure 20:
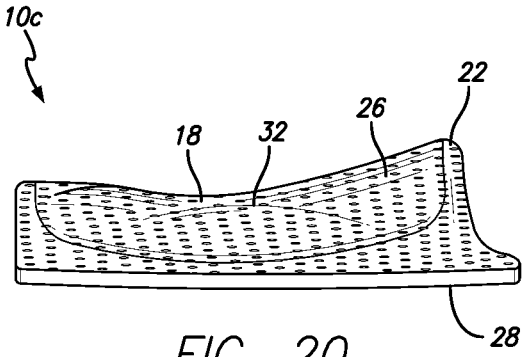
Figure 21:
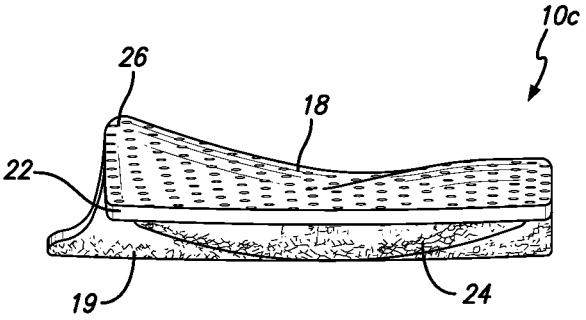
Figure 22:
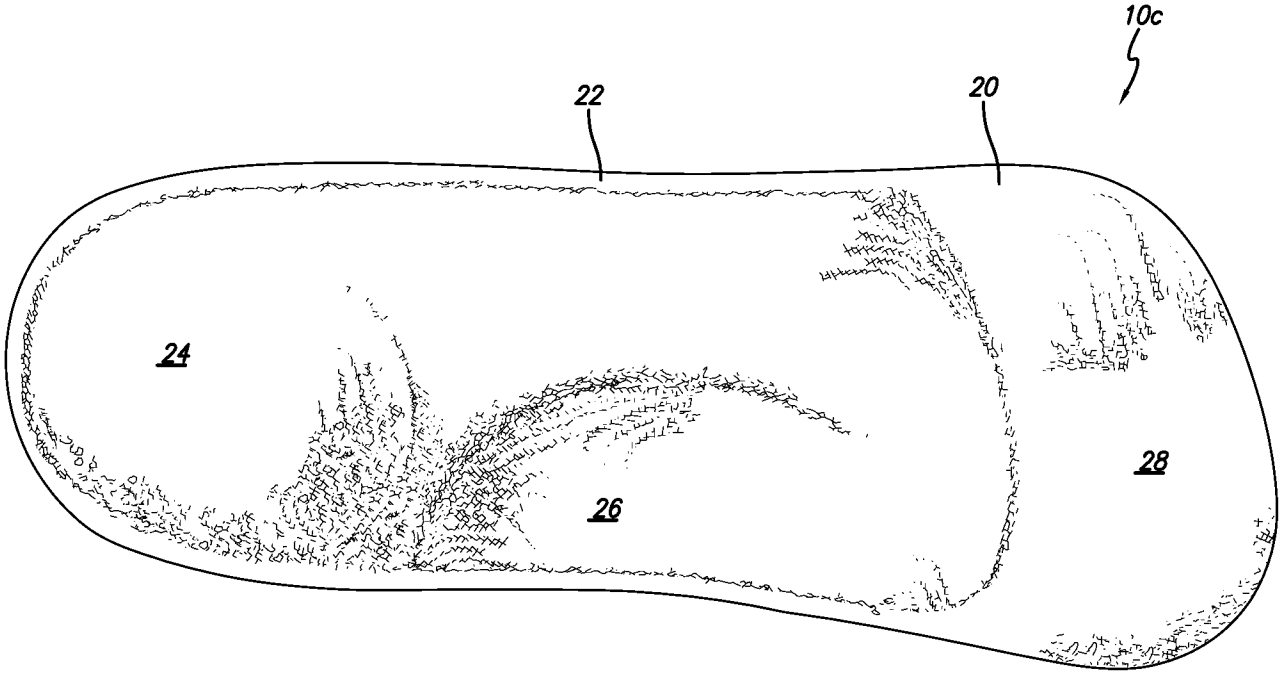
Figure 23:
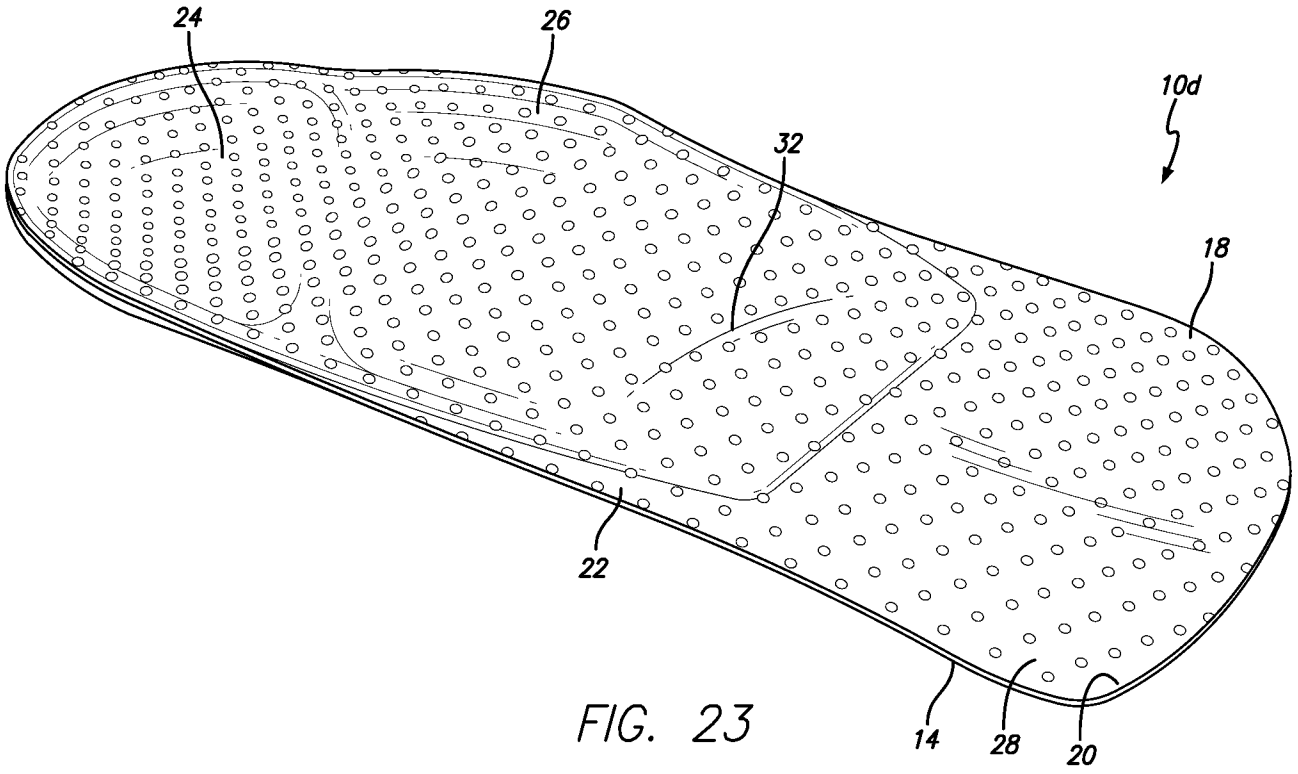
Figure 24:
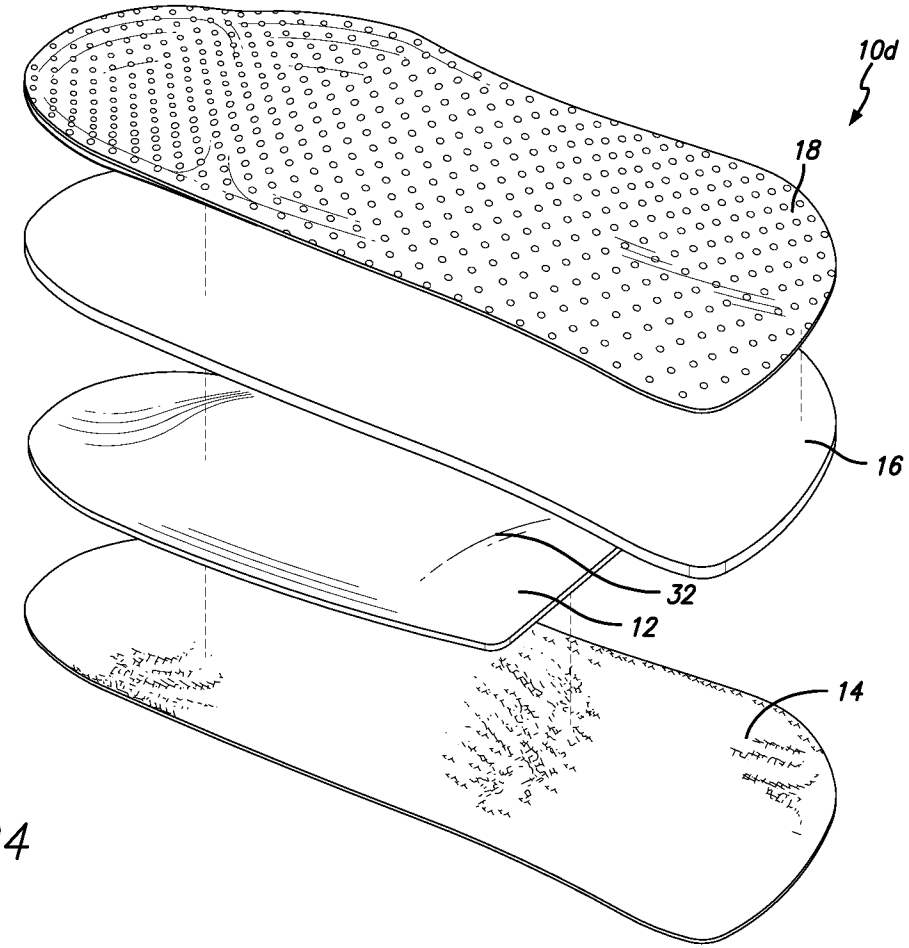
Figure 25:
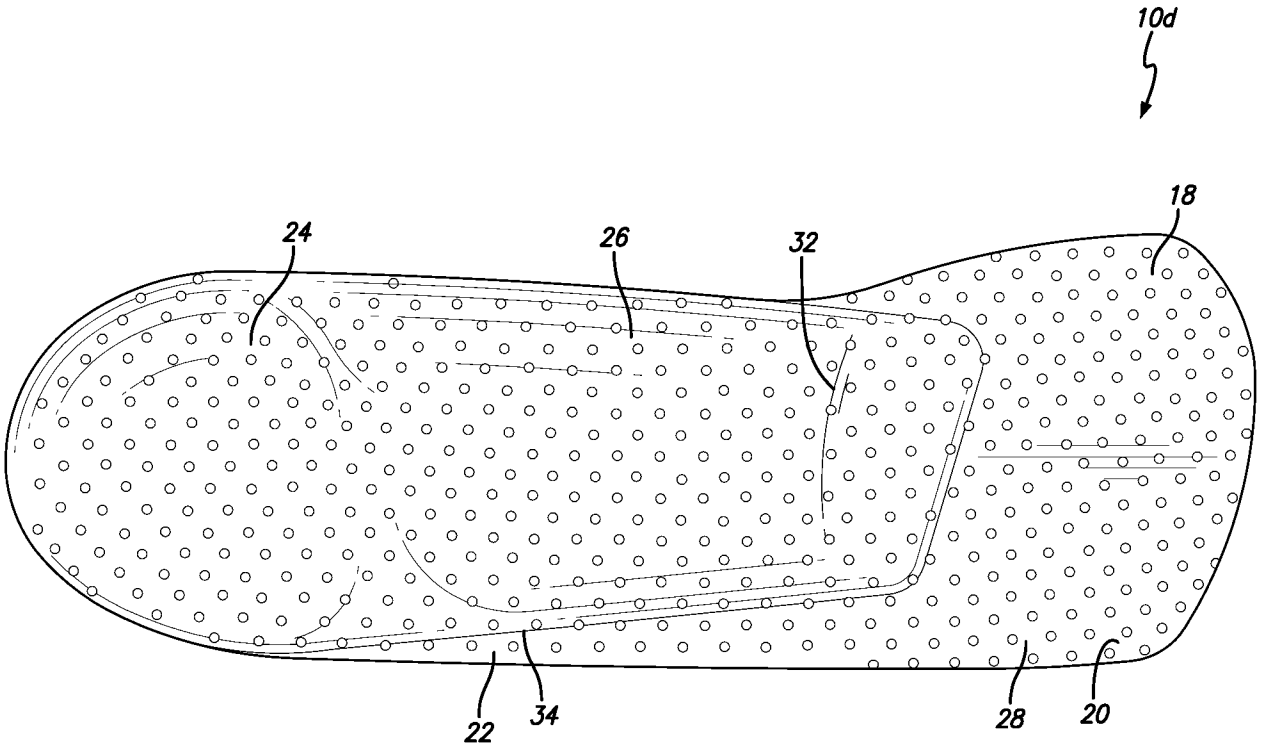
Figure 26:
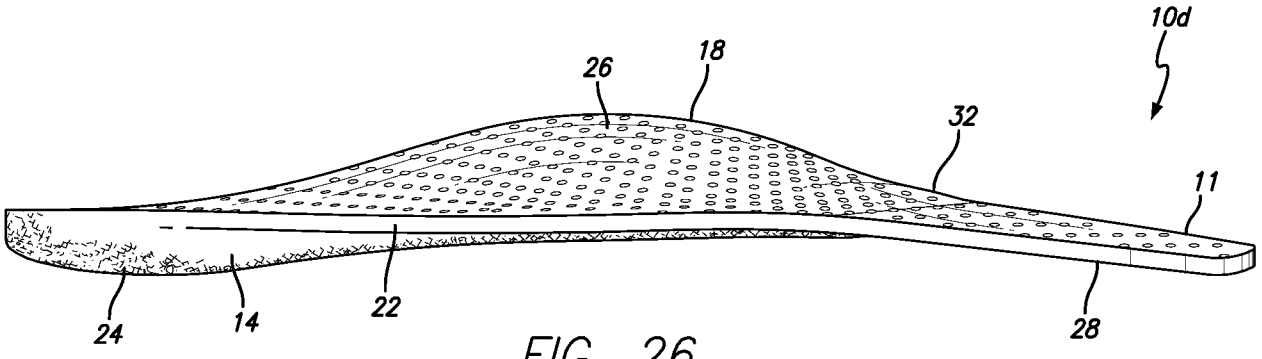
Figure 27:
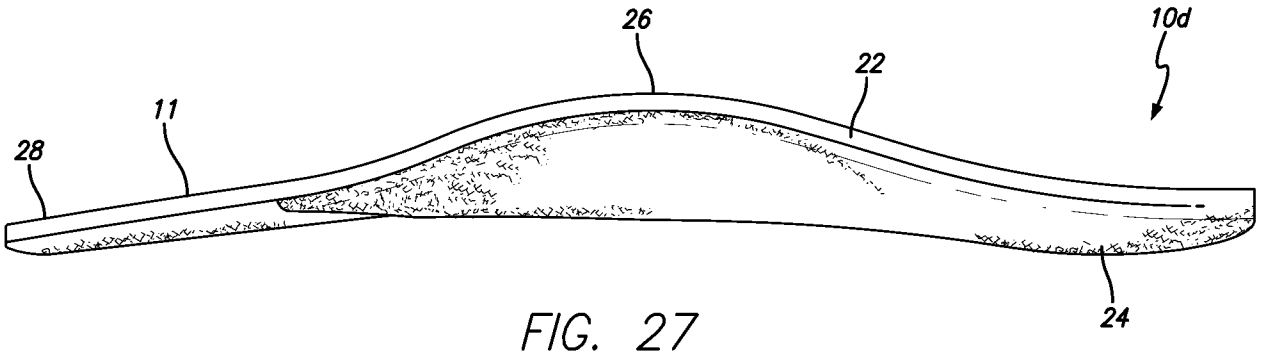
Figure 28:
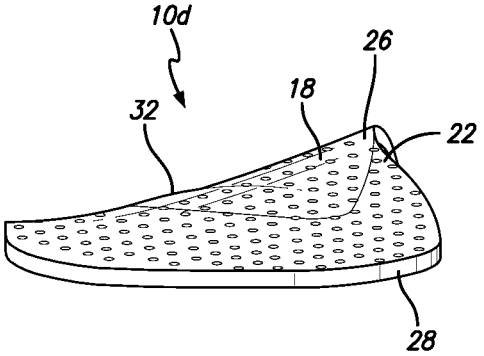
Figure 29:
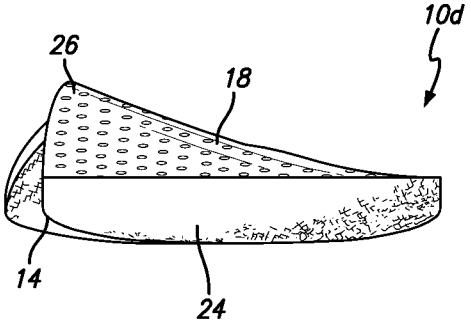

FIG, 4 is a right side elevational view of the shoe insert of FIG. 1;

FIG. 5 is a left side elevational view of the shoe insert of FIG. 1;

FIG. 6 is a front elevational view of the shoe insert of FIG. 1;

FIG. 7 is a rear elevational view of the shoe insert of FIG. 1;

FIG. 8 is a perspective view of a shoe insert in accordance with a second preferred embodiment of the present invention;

FIG. 9 is an exploded view of the shoe insert of FIG. 8;

FIG. 10 is a bottom plan view of the shoe insert of FIG. 8;

FIG. 11 is a right side elevational view of the shoe insert of FIG. 8;

FIG. 12 is a left side elevational view of the shoe insert of FIG. 8;

FIG, 13 is a front elevational view of the shoe insert of FIG. 8;

FIG. 14 is a rear elevational view of the shoe insert of FIG. 8;

FIG. 15 is a perspective view of a shoe insert in accordance with a third preferred embodiment of the present invention;

FIG. 16 is an exploded view of the shoe insert of FIG. 15;

FIG. 17 is a top plan view of the shoe insert of FIG. 15;

FIG. 18 is a right side elevational view of the shoe insert of FIG. 15;

FIG. 19 is a left side elevational view of the shoe insert of FIG. 15;

FIG. 20 is a front elevational view of the shoe insert of FIG. 15;

FIG. 21 is a rear elevational view of the shoe insert of FIG. 15;

FIG. 22 is a bottom plan view of the shoe insert of FIG. 15;

FIG. 23 is a perspective view of a shoe insert in accordance with a fourth preferred embodiment of the present invention;

FIG. 24 is an exploded view of the shoe insert of FIG. 23;

FIG. 25 is a top plan view of the shoe insert of FIG. 23;

FIG. 26 is a right side elevational view of the shoe insert of FIG. 23;

FIG. 27 is a left side elevational view of the shoe insert of FIG, 23;

FIG. 28 is a front elevational view of the shoe insert of FIG. 23;

FIG. 29 is a rear elevational view of the shoe insert of FIG. 23

Figure 30:
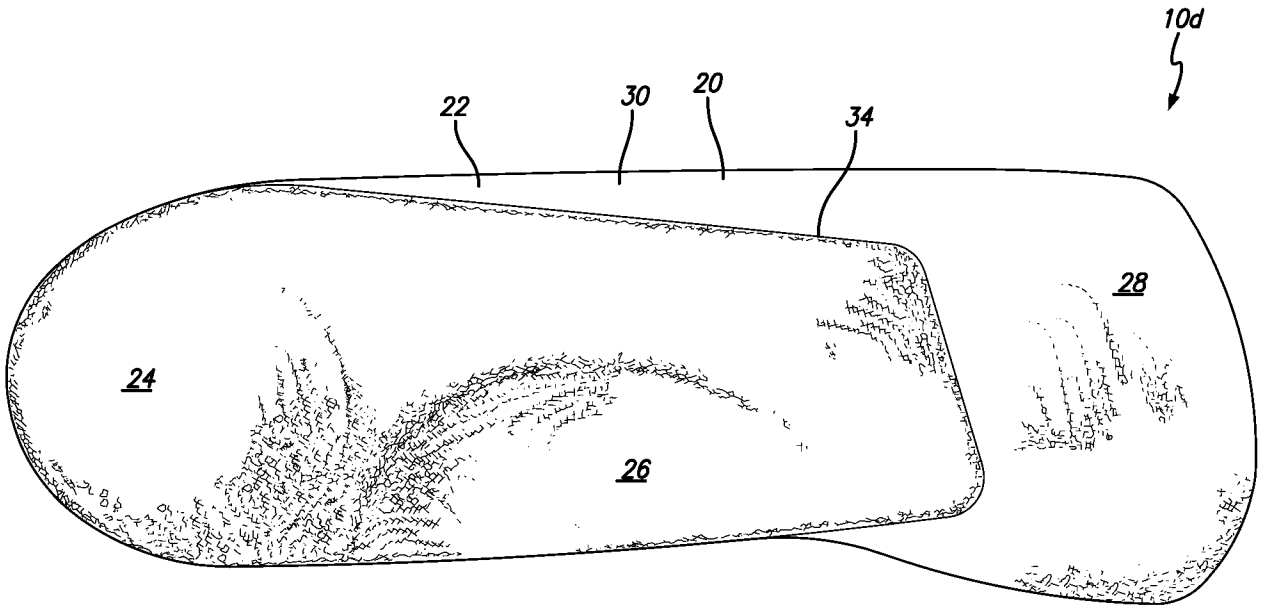
Figure 31:
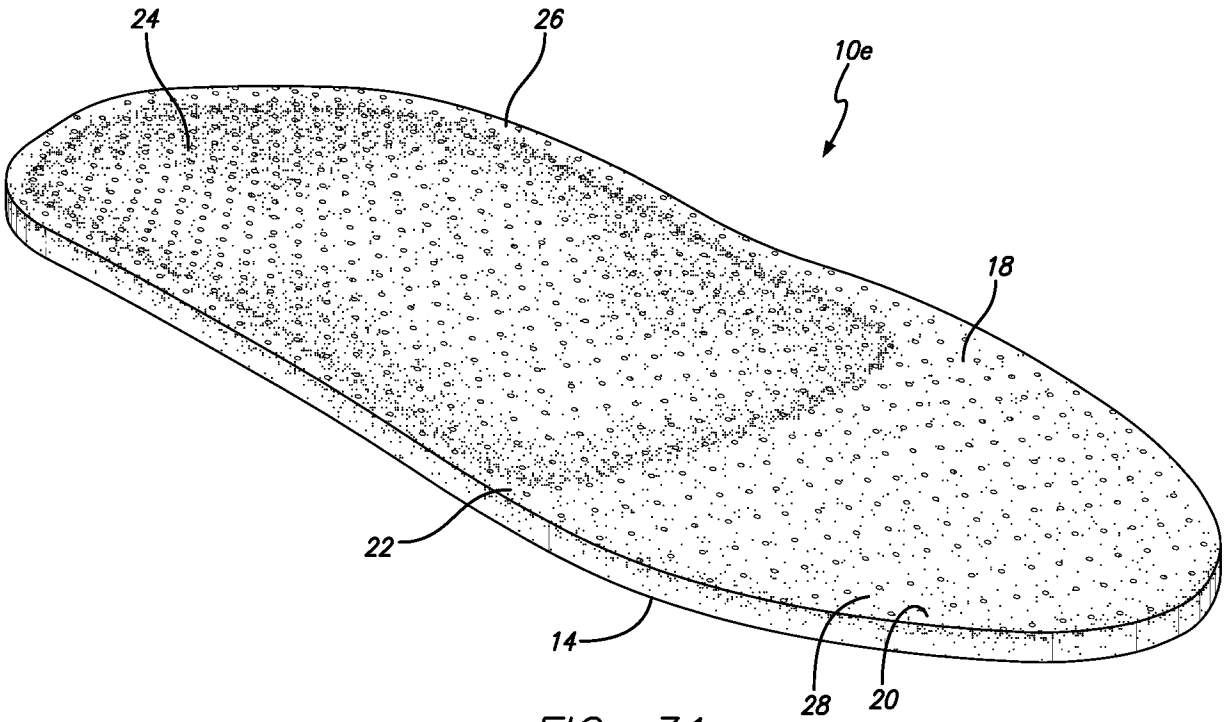
Figure 32:
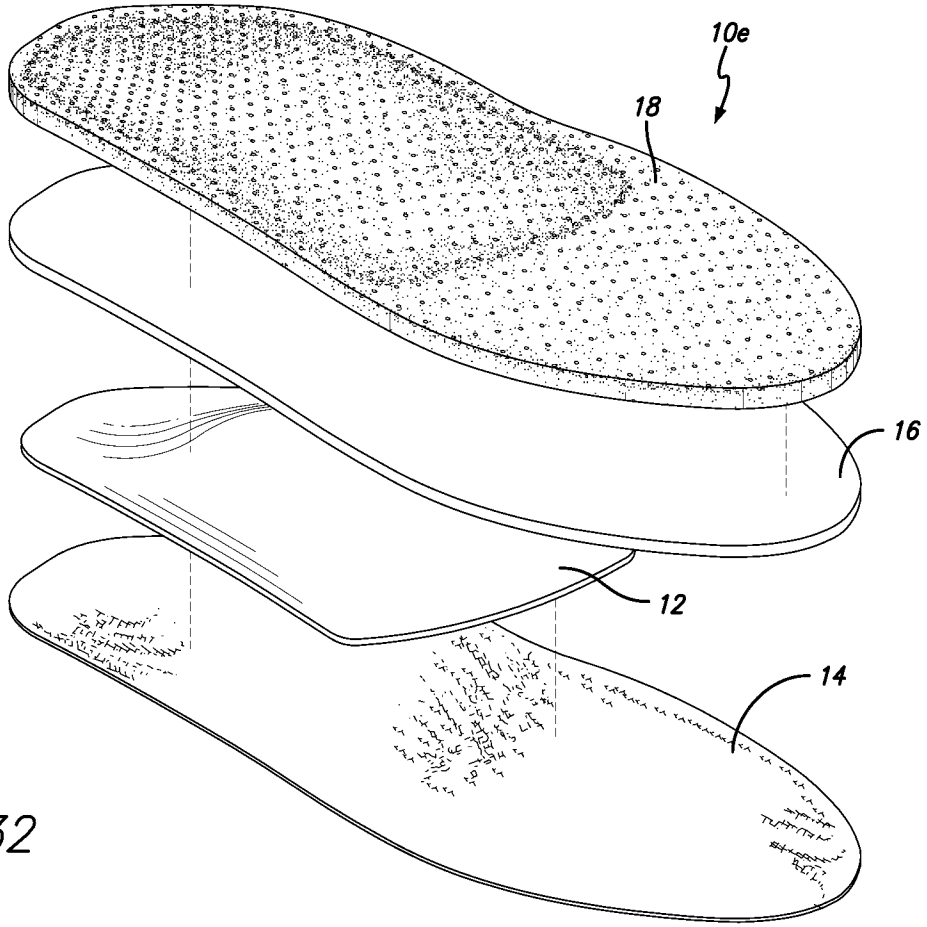
Figure 33:
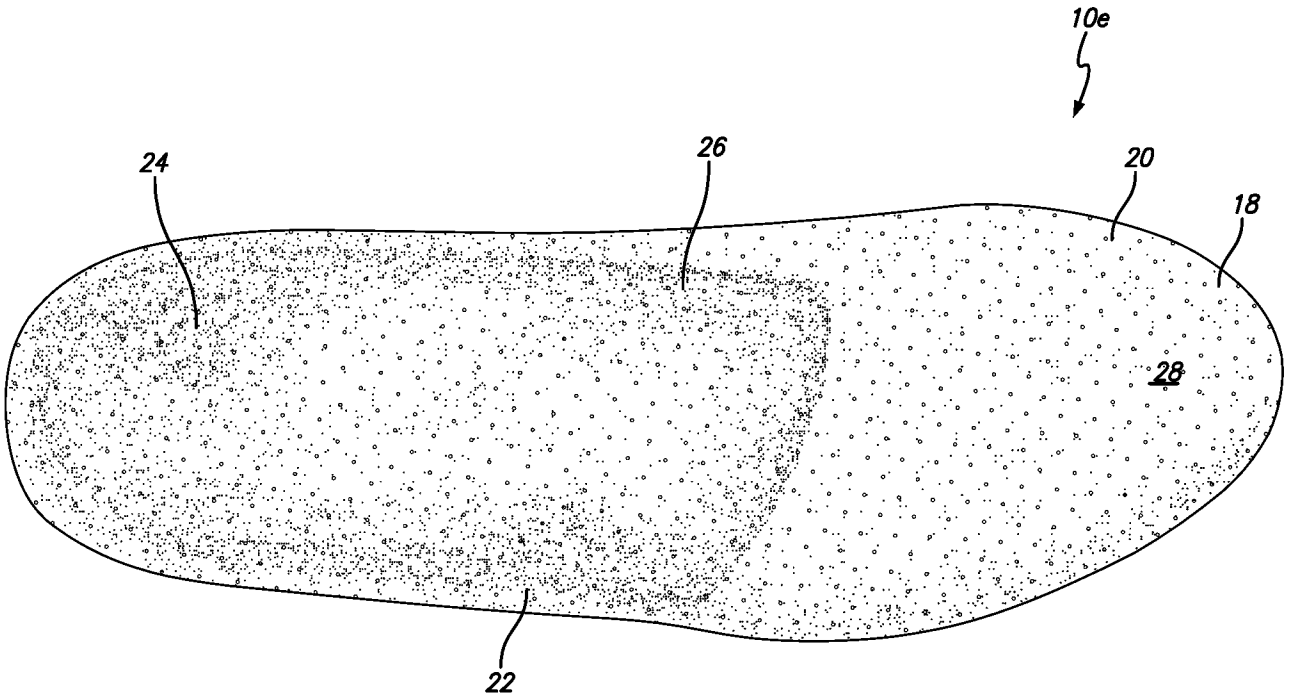
Figure 34:
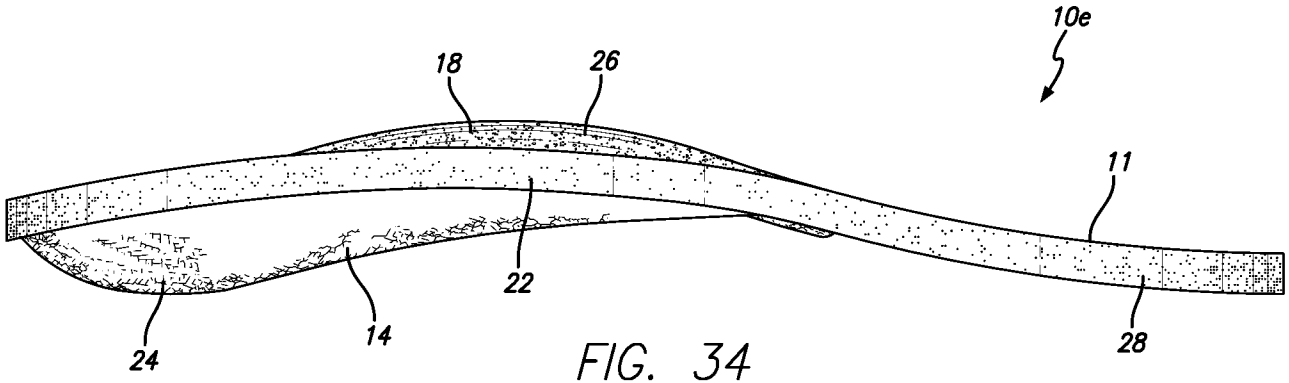
Figure 35:
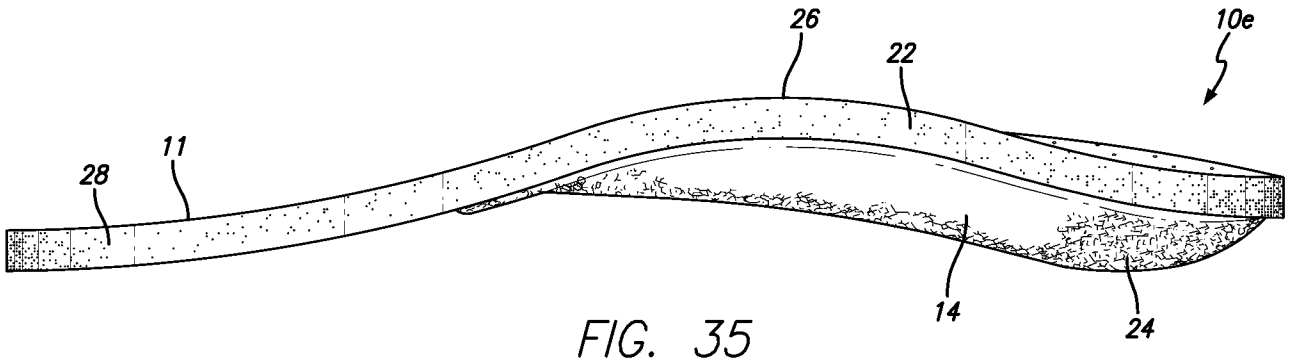
Figure 36:
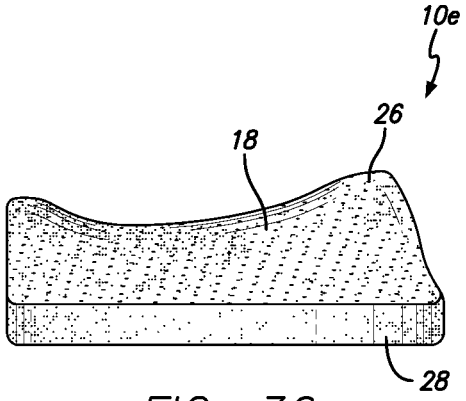
Figure 37:
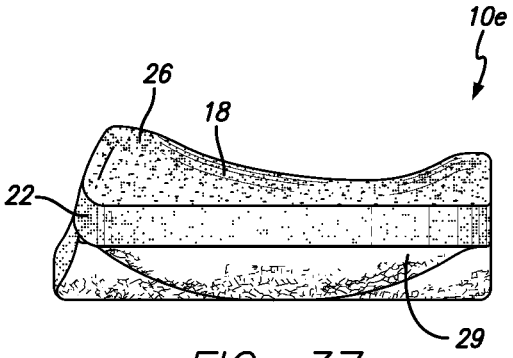

FIG. 30 is a bottom plan view of the shoe insert of FIG. 23;

FIG. 31 is a perspective view of a shoe insert in accordance with a fifth preferred embodiment of the present invention;

FIG. 32 is an exploded view of the shoe insert of FIG. 31;

FIG. 33 is a top plan view of the shoe insert of FIG. 31;

FIG. 34 is a right side elevational view of the shoe insert of FIG. 31;

FIG. 35 is a left side elevational view of the shoe insert of FIG. 31;

FIG. 36 is a front elevational view of the shoe insert of FIG. 31;

FIG. 37 is a rear elevational view of the shoe insert of FIGS. 31; and

Figure 38:
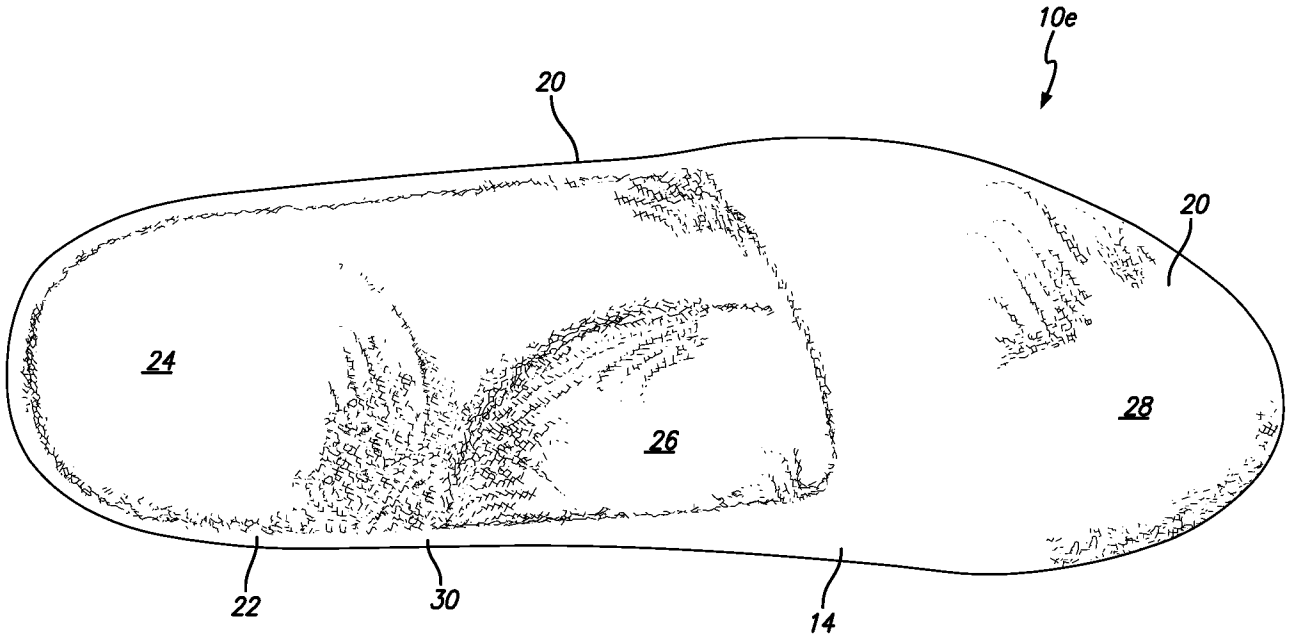

FIG. 38 is a bottom plan view of the shoe insert of FIG. 31.

DETAILED DESCRIPTION OF THE PREFERRED EMBODIMENTS

The following description and. drawings are illustrative and are not to be construed as limiting. Numerous specific details are described to provide a thorough understanding of the disclosure. However, in certain instances, well-known or conventional details are not described in order to avoid obscuring the description. References to one or an other embodiment in the present disclosure can be, but not necessarily are, references to the same embodiment; and, such references mean at least one of the embodiments.

Reference in this specification to "one embodiment" or "an embodiment" means that a particular feature, structure, or characteristic described in connection with the embodiment is included in at least one embodiment of the disclosure. Appearances of the phrase "in one embodiment" in various places in the specification do not necessarily refer to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks: The use of highlighting has no influence on the scope and meaning of a term; the scope and meaning of a term is the same, in the same context, whether or not it is highlighted. It will be appreciated that the same thing can be said in more than one way.

Consequently, alternative language and synonyms may be used for any one or more of the terms discussed herein. Nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and is not intended to further limit the scope and meaning of the disclosure or of any exemplified term. Likewise, the disclosure is not limited to various embodiments given in this specification.

Without intent to further limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains In the case of conflict, the present document, including definitions, will control.

It will be appreciated that terms such as "front," "back," "top," "bottom," "side," "short," "long," "up," "down," and "below" used herein are merely for ease of description and refer to the orientation of the components as shown in the thanes. It should be understood that any orientation of the components described herein is within the scope of the present invention.

Referring now to the drawings, wherein the showings are for purposes of illustrating the present invention and not for purposes of limiting the same, FIGS. 1-38 show five embodiments of shoe inserts 10*a*-10*e* (referred to generally herein as insert 10). In a preferred embodiment, the insert 10*a* shown in FIGS. 1-7 is intended to be used in sports shoes (i.e., sneakers) (typically worn by men), the insert 10b shown in FIGS. 8-14 is intended to be used in dress or business shoes (typically worn by men), the insert 10*c* shown in FIGS. 15-22 is intended to be used in boots (typically worn by women), the insert 10*d* shown in FIGS. 23-30 is intended to be used in high heels (typically worn by women), and the insert 10*e* shown in FIGS. 31-38 is intended to be used in sports shoes (typically worn by women). However, none of these categorizations are a limitation on the present invention or any of the specific inserts.

Figure 2:
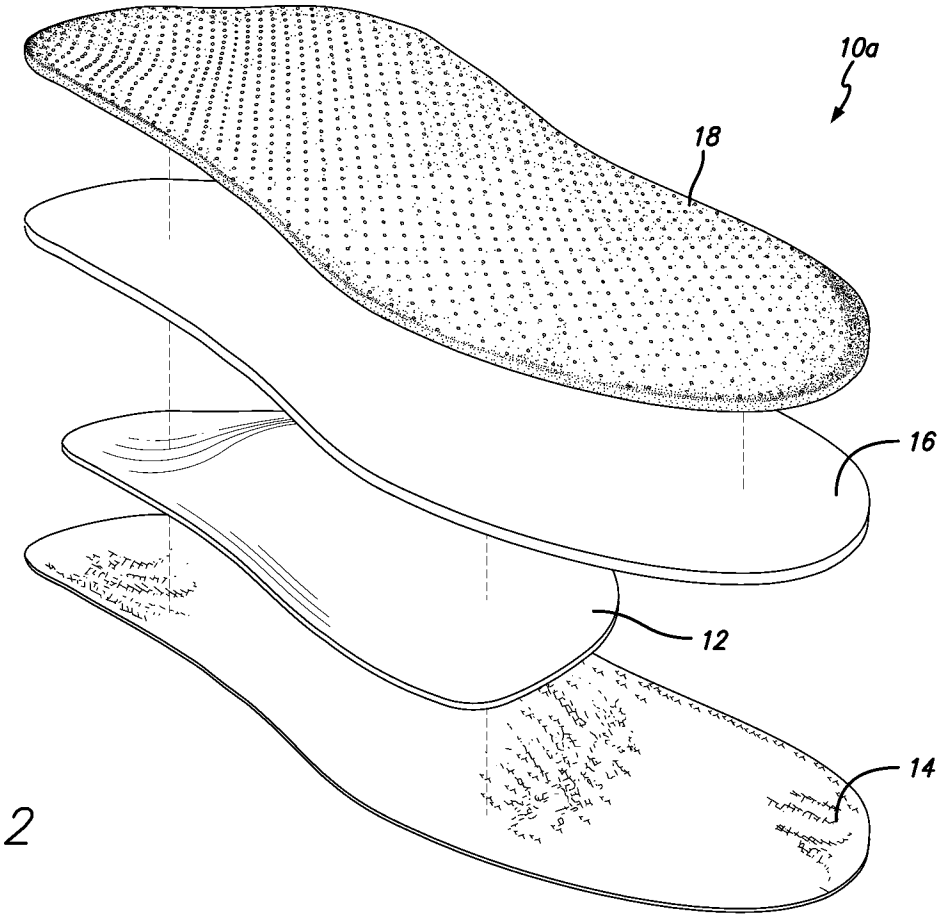
FIG. 2 is an exploded view of the shoe insert of FIG. 1.

Shoe insert 10*a* will be described first. As shown in FIG. 2, in a preferred embodiment, the insert 10 includes a base layer 12, a bottom layer 14, a middle layer 16 arid a top layer 18. In a preferred embodiment, the base layer 12 is made of a rigid material, such as polypropylene, that can maintain shape and position and that can form to the wearer's foot and correct the foot upon impact and pressure (as described below). The base layer 12 can be made of other materials with these characteristics, such as other thermoplastic polymers and other FDA compliant polymers.

In a preferred embodiment, the bottom, middle and top layers 14, 16 and 18 are made of relatively soft materials. For example, in a preferred embodiment, the bottom layer 14 is made of a suede material, which helps prevent slippage during use, the middle layer 16 is made of a foam or pad. For example, a closed cell ethylene-vinyl acetate (EVA) foam such as P-CELL® padding can be used. In a preferred embodiment, the top layer 18 is made of a perforated closed cell EVA foam. In another embodiment, the middle layer 16 can be made of other padding materials, such as those available from PORON®. In another embodiment, the top layer 18 can be made of PLASTAZOTE® or other foams, such as those available from SPENCO®, PORON® or the like, leather, vinyl, bamboo, suede or other material. All of the layers (base 12, bottom 14, middle 16 and top 18) are secured/adhered together to form the insert 10. In a preferred embodiment, the layers are adhered to one another via glue. The various layers can also be attached to one another via stitching or the like. in another embodiment, the bottom layer 14 can be made of vinyl, EVA, materials from PORON® or materials from SPENCO®. In another embodiment, the bottom layer 14 can be omitted.

Figure 3:
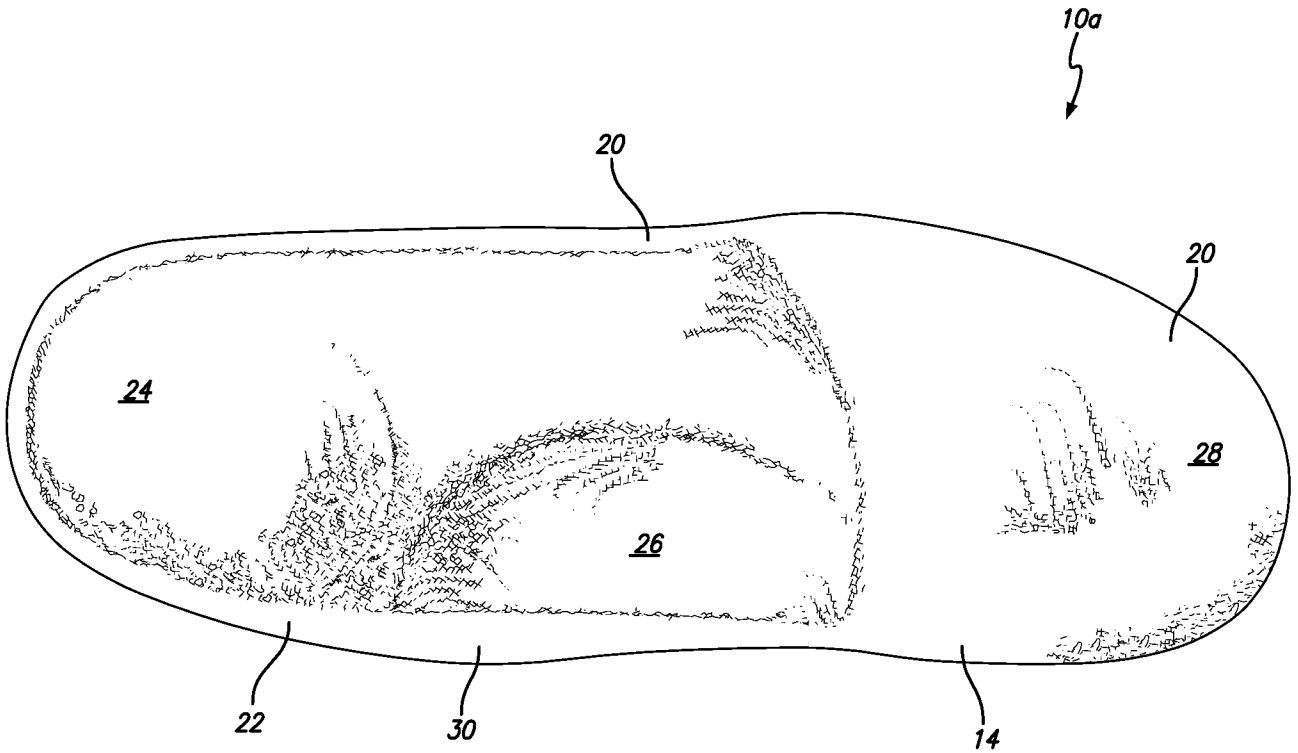
FIG. 3 is a bottom plan view of the shoe insert of FIG. 1.
Figure 4:
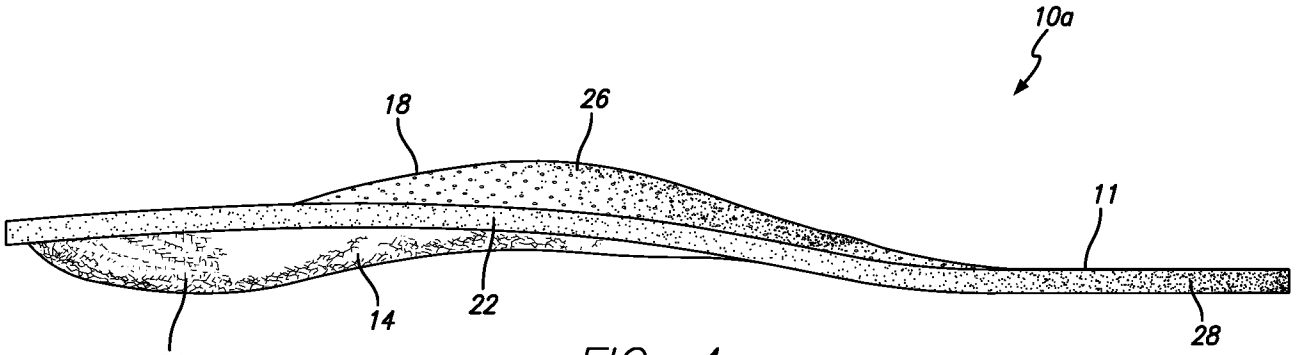

As is shown in FIG. 2, in a preferred embodiment, the bottom, middle and top layers 14, 16 and 18 are sized to cover a wearer's foot from heel to toes and from side to side. However, the base layer 12 is only sized to extend from a wearer's heel to just passed the wearer's arch or midfoot. As a result of this sizing, the bottom, middle and top layers 14, 16 and 18 together form a soft portion 20, that includes a border portion 22 that extends around the base layer 12 (see, e.g., FIG. 1), which is rigid. In a preferred embodiment, the insert 10*a* includes a flare portion 30, which, as described more fully below, helps retain the insert 10*a* in position when inserted into a shoe. Preferably, the flare portion 30 is part of and extends outwardly from the border portion 22 and is formed via the shape of the bottom, middle and top layers 14, 16 and 18 in the arch portion 26. As shown in FIG. 3, in a preferred embodiment, the flare portion 30 is located on the inner part of the insert 10*a* (i.e., the portion of the insert 10*a* that corresponds to the inner portion of a user's foot) In another embodiment, the insert 10*a* can also include a flare portion m the outer part thereof.

As is shown in FIGS. 1 and 4-7, the insert 10*a* defines a main body portion 11 that generally includes a heel cup 24, an arch portion 26 and a forefoot portion 28. In use, the heel cup 24 stabilizes a user's heel, the arch portion 26 supports a user's arch and the forefoot portion 28, which is part of the soft portion 20, pads the user's forefoot. The padding quality of the insert 10 is the reason that the relatively hard plastic base layer 12 does not extend into the forefoot portion 28 of the insert 10. In another embodiment, the base layer 12 can extend to the forefoot portion 28. It will be understood that the dimensions and/or colors of the present invention and the layers of the insert are not a limitation. However, in an exemplary embodiment, insert 10*a* includes base layer 12, which comprises a polypro shell, bottom layer 14, which comprises blue suede from heel to toes, middle layer 16, which comprises 1/16" black P-cell padding heel to toes, and top layer 18, which comprises 1/16" blue perforated R&B EVA foam (closed cell) heel to toes.

For the dress insert 10*b*, which is shown in FIGS. 8-14, in a preferred embodiment, the materials for the base, bottom and middle layers 12, 14 and 16 are the same as insert 10*a*, but the top layer 18 is preferably made of a synthetic leather, such as BIOSKIN®, vinyl or similar material. Preferably, the material is antifungal, antibacterial and breathable. However, this is not necessary nor a limitation on the present invention. Furthermore, the flare portion 30 can be omitted from the dress insert 10*b*. However, the flare portion 30 can be included, if desired. In an exemplary embodiment, insert 10*b* includes base layer 12, which comprises a polypro shell, bottom layer 14, which comprises black suede from heel to toes, middle layer 16, which comprises 1/16" black P-cell padding heel to toes, and top layer 18, which comprises black bio-skin synthetic leather heel to toes.

FIGS. 15-22 show insert 10*c*, which can be used in women's boots. Insert 10*c* is similar to the inserts described above and includes base layer 12, and bottom, middle and top layers 14, 16 and 18. However, in a preferred embodiment, the insert 10*c* is not sized to cover a wearer's foot from heel to toes, but instead only extends to adjacent a wearer's sulcus. As will be appreciated by those of ordinary skill in the art, this means that, in a preferred embodiment, the bottom, middle and top layers 14, 16 and 18 extend forwardly to just under the metatarsal heads and do not extend to the toes or under the distal phalanges. Furthermore, as shown in FIG. 15, in a preferred embodiment, insert 10*c* includes a met pad or raised portion 32 that is preferably positioned adjacent the wearers 2-4 mets. Raised portion 32 is preferably a raise or bump in the base layer 12 that helps to displace weight from the met heads to the metatarsal shafts, which is advantageous for women wearing boots with high heels or more traditional high heels (insert 10*d*, described below, also includes a met pad or raised portion 32). It will be appreciated by those of skill in the art that, in a preferred embodiment, the base layer 12 and bottom, middle and top layers 14, 16 and 18 are finished 1-4 metatarsals, instead of 1-5 metatarsals because a 1-5 finish typically will not fit in a women's dress device. However, in another embodiment, insert 10*c* or 10*d* can be finished 1-5 metatarsals.

Similar to inserts 10*a* and 10*b*, in a preferred embodiment, the base layer 12 is sized to extend from a wearers heel to just passed the wearers arch or midfoot. As a result of this sizing, the bottom, middle and top layers 14, 16 and 18 together form a soft portion 20, that includes a border portion 22 that extends around the base layer 12, which is rigid. In a preferred embodiment, the insert 10*c* includes a flare portion 30.

As is shown in FIGS. 15 and 17-21, the insert 10*c* defines a main body portion 11 that generally includes a heel cup 24, an arch portion 26 and a forefoot portion 28. However, as described above, the forefoot portion 28 preferably only extends to the sulcus. In use, the heel cup 24 stabilizes a user's heel, the arch portion 26 supports a user's arch and the forefoot portion 28, which is part of the soft portion 20, pads the user's forefoot, The padding quality of the insert 10 is the reason that the relatively hard plastic base layer 12 does not extend into the forefoot portion 28 of the insert 10. In another embodiment, the base layer 12 can extend to the forefoot portion 28.

In an exemplary embodiment, insert 10*c* includes base layer 12, which comprises a polypro shell from 1-4 mets and includes a raised portion or met pad, bottom layer 14, which comprises back suede from heel to sulcus (1-4 material from 1st met to 4th), middle layer 16 (1-4 material from 1st met to 4th), which comprises 1/16" black P-cell padding heel to sulcus, and top layer 18 (1-4 material from 1st met to 4th). which comprises black bio-skin synthetic leather heel to sulcus.

As shown in FIGS. 23-30, insert 10*d* is similar to insert 10*c*, but is sized to preferably fit into a women's high heel shoe or device. As shown in FIG. 30, in a preferred embodiment, border portion 22 only extends partially around base layer 12. And, base layer 12 includes an angled edge 34 that, together with border portion 22 forms an outer flare portion 30. In an exemplary embodiment, insert 10*d* includes base layer 12, which comprises a polypro shell from 1-4 mets and includes a raised portion or met pad, bottom layer 14, which comprises back suede from heel to sulcus (1-4 material from 1st met to 4th), middle layer 16 (1-4 material from 1st met to 4th), which comprises 116" black P-cell padding heel to sulcus, and top layer 18 (1-4 material from 1st met to 4th), which comprises black bio-skin synthetic leather heel to sulcus.

As shown in FIGS. 31-38, insert 10*e* is similar to insert 10*a*, but is sized to preferably fit into a women's sport shoe or sneaker. In an exemplary embodiment, insert 10*e* includes base layer 12, which comprises a polypro shell, bottom layer 14, which comprises red suede from heel to toes, middle layer 16, which comprises ⅛" black P-cell padding heel to toes, and top layer 18, which comprises 1/16" red perforated R&B EVA foam (closed cell) heel to toes.

It will be appreciated by those skilled in the art that ambulation is made up of three positions; heel strike, midstance and propulsion. Propulsion is where the person's foot is leaving the ground. Optimally, the foot is in a neutral position at this point. When a user walks in shoes that include the insert 10 therein, the three positions of ambulation are "sensed" and, over time, a slow transition is made until the user's foot is placed into an approximately neutral position during propulsion. This occurs as a result of the user's weight distribution in all three planes of active ambulation, frontal, sagital, and transverse.

In use, the insert 10 is placed in a shoe (typically two inserts 10 would be placed in two shoes). In a preferred embodiment, the insert 10 is placed in anew shoe. However, this is not a limitation. As the user begins walking, when a user's heel strikes, the insert 10 begins to align the user's foot to a neutral position. This causes the middle layer 16 to mold to the shape of the user's foot after repeated striking. In an exemplary embodiment, it takes six to eight hours of wear or use until the material is set. The heel cup 24 deepens after repeated use and will maintain the formed shape even after not being used for a long period of time. As a result of the heat of the wearer's foot, the middle layer 12, and therefore the insert 10, forms to the bottom of the wearer's foot to provide a neutral ambulation. In other words, the insert 10 essentially "senses" the need of correction and puts the wearer's foot in a neutral position for optimal ambulation. And, due to the thickness of the base layer 12 and the heat of the wearers foot, the base layer 12 forms to a shape to provide this optimal ambulation.

The middle layer 16 molds to the user's arch and adjust to the abnormal pressures of the foot until the weight is distributed approximately evenly throughout the insert 10. In an exemplary embodiment, this approximately molding that produces approximately even weight distribution occurs after about seven to ten days of wearing shoes that include the inserts 10. For this reason, the inserts 10 may be uncomfortable to some users when they are first inserted.

When the insert 10 is placed in a shoe, the insert 10 is in a pre-position for any foot that ambulates from heel strike to midstance to propulsion. In use, once the heel of the shoe hits the ground the insert 10 then centers and forms around the foot to keep it balanced. Next, as midstance begins the center of the insert 10 rises till the arch resists the elevation of the insert 10. Preferably, an equal distribution is maintained across the width of the insole insert 10. Next, in propulsion the heat generated by the friction of the user's foot (and the user's body heat) to the insert 10 to the shoe from ambulating and the weight of the wearer are approximately evenly distributed. Therefore, the insert 10 is actively molding to the user's foot as a result of the ground reactive force pushing on the orthotic and the heat to form the insert 10 into a neutral appliance. Therefore, the insert 10 actively forms and captures all three planes of ambulation, frontal, sagital and transverse, in that formation.

An exemplary manufacturing process of an insert 10*a*, 10*b*, 10*c*, 10*d* and 10*e* will now be described. A prefabricated base layer 12 is pulled from inventory based on shoe size. The top layer 18 and middle layer 16 are adhered together by applying glue to both layers and a layer of glue is applied to the bottom of middle layer 16. Once this is tacky it is then worked over the top of the base layer 12 to prevent or remove air pockets. Then the bottom layer 14 is adhered to the bottom surface of the base layer and the bottom of the middle layer 16.

It will be appreciated by those skilled in the art that the insert 10 described herein can be sold in retail stores and can help align a users foot to a neutral position after use. In other words, the insert 10 can provide correction to the user's gait, but does not require a doctor's customization.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description of the Preferred Embodiments using the singular or plural number may also include the plural or singular number respectively. The word "or" in reference to a list of two or more items, covers all of the following interpretations of the word: any of the items in the list, all of the items in the list, and any combination of the items in the list.

The above-detailed description of embodiments of the disclosure is not intended to be exhaustive or to limit the teachings to the precise form disclosed above. While specific embodiments of and examples for the disclosure are described above for illustrative purposes, various equivalent modifications are possible within the scope of the disclosure, as those skilled in the relevant art will recognize. For example, while processes or blocks are presented in a given order, alternative embodiments ay perform routines having steps, or employ systems having blocks, in a different order, and some processes or blocks may be deleted, moved, added, subdivided, combined, and/or modified to provide alternative or subcombinations. Each of these processes or blocks may be implemented in a variety of different ways. Also, while processes or blocks are at times shown as being performed in series, these processes or blocks may instead be performed in parallel, or may be performed, at different times. Further any specific numbers noted herein are only examples: alternative implementations may employ differing values or ranges.

The teachings of the disclosure provided herein can be applied to other systems, not necessarily the system described above. The elements and acts of the various embodiments described above can be combined to provide further embodiments.

Any patents and applications and other references noted above, including any that may be listed in accompanying filing papers, are incorporated herein by reference in their entirety. Aspects of the disclosure can be modified, if necessary, to employ the systems, functions, and concepts of the various references described above to provide yet further embodiments of the disclosure.

These and other changes can be made to the disclosure in light of the above Detailed Description of the Preferred Embodiments. While the above description describes certain embodiments of the disclosure, and describes the best mode contemplated, no matter how detailed the above appears in text, the teachings can be practiced in many ways. Details of the system may vary considerably in its implementation details, while still being encompassed by the subject matter disclosed herein. As noted above, particular terminology used when describing certain features or aspects of the disclosure should not be taken to imply that the terminology is being redefined herein to be restricted to any specific characteristics, features or aspects of the disclosure with which that terminology is associated. In general, the terms used in the following claims should not be construed to limit the disclosures to the specific embodiments disclosed in the specification unless the above Detailed Description of the Preferred Embodiments section explicitly defines such terms. Accordingly, the actual scope of the disclosure encompasses not only the disclosed embodiments, but also all equivalent ways of practicing or implementing the disclosure under the claims.

While certain aspects of the disclosure are presented below in certain claim forms, the inventors contemplate the various aspects of the disclosure in any number of claim forms. For example, while only one aspect of the disclosure is recited as a means-plus-function claim under 35 U.S.C. §112, ¶6, other aspects may likewise be embodied as a means-plus-function claim, or in other forms, such as being embodied in a computer-readable medium. (Any claims intended to be treated under 35 U.S.C. §112, ¶6 will begin with the words "means for"). Accordingly, the applicant reserves the right to add additional claims after filing the application to pursue such additional claim forms for other aspects of the disclosure.

Accordingly, although exemplary embodiments of the invention have been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A shoe insert comprising:

a base layer having a top and a bottom surface, wherein the base layer is comprised of a thermoplastic polymer, a middle layer having a top and a bottom surface, wherein a first portion of the bottom surface of the middle layer is adhered to the top surface of the base layer, a top layer having a top and a bottom surface, wherein the bottom surface of the top layer is adhered to the top surface of the middle layer, a bottom layer having a top and a bottom surface, wherein the bottom surface of the base layer is adhered to the top surface of the bottom layer, wherein a second portion of the bottom surface of the middle layer is adhered to the top surface of the bottom layer, wherein the base layer, middle layer and top layer cooperate to define a main body portion, wherein the main body portion includes a heel cup, an arch portion and a forefoot portion, wherein the forefoot portion comprises a front part of the middle layer, a front part of the top layer, a front part of the bottom layer and no part of the base layer, wherein the main body portion includes a border portion that extends at least partially around the base layer, wherein the border portion comprises a border part of the bottom layer, a border part of the middle layer, a border part of the top layer, and no part of the base layer, wherein the border part of the bottom layer is adhered to the border part of the middle layer, and wherein the border part of the middle layer is adhered to the border part of the top layer, and wherein the border portion has an outside edge, wherein the main body portion includes a flare portion that extends outwardly from the outside edge of the border portion in a transverse direction and is adjacent the arch portion, wherein the flare portion comprises a flare part of the bottom layer, a flare part of the middle layer, a flare part of the top layer, and no part of the base layer, wherein the flare portion includes a top surface and a bottom surface, wherein the top surface of the top layer is coplanar with the top surface of the flare portion, and wherein the bottom surface of the bottom layer is coplanar with the bottom surface of the flare portion.

2. The shoe insert of claim 1 wherein the base layer is comprised of polypropylene.

3. The shoe insert of claim 2 wherein the middle layer is made of ethylene-vinyl acetate foam.

4. The shoe insert of claim 3 wherein the top layer is made of ethylene-vinyl acetate foam.

5. The shoe insert of claim 4 wherein the bottom layer is made of suede.

6. The shoe insert of claim 1 wherein the shape of the arch portion is molded into the base layer prior to adhering the bottom and middle layers thereto.

7. The shoe insert of claim 1 wherein the main body portion comprises a soft portion that surrounds the base layer.

8. The shoe insert of claim 1 wherein the base layer includes a front edge, a rear edge and a length, wherein a raised portion is defined in the base layer, wherein the raised portion begins at the front edge and extends rearwardly toward the rear edge, wherein the raised portion extends less than half the length of the base layer and is adapted to be positioned adjacent a wearer's 2-4 metatarsal bones when the insert is positioned in a properly fitted shoe.

9. The shoe insert of claim 8 wherein the forefoot portion includes a front edge, and wherein the front edge is adapted to only extend to adjacent a wearer's sulcus when the insert is positioned in a properly fitted shoe.

10. The shoe insert of claim 1 wherein the base layer is adapted to be actively molded to the shape of a wearer's foot during use.

11. The shoe insert of claim 10 wherein the base layer is adapted to be actively molded to the shape of a wearer's foot during use as a result of the wearer's body heat and weight changing the shape of the base layer.

12. The shoe insert of claim 11 wherein the base layer is adapted to be actively molded to the shape of a wearer's foot due to both ground reactive force pushing on the shoe insert and the wearer's body heat, whereby the shoe insert is formed into a neutral appliance.

13. The shoe insert of claim 1 wherein the base layer is a single layer.

14. A shoe insert comprising:

a base layer having a top and a bottom surface, wherein the base layer is a single layer comprised of polypropylene, a middle layer having a top and a bottom surface, wherein a first portion of the bottom surface of the middle layer is adhered to the top surface of the base layer, a top layer having a top and a bottom surface, wherein the bottom surface of the top layer is adhered to the top surface of the middle layer, a bottom layer having a top and a bottom surface, wherein the bottom surface of the base layer is adhered to the top surface of the bottom layer, wherein a second portion of the bottom surface of the middle layer is adhered to the top surface of the bottom layer, wherein the base layer, middle layer, bottom layer and top layer cooperate to define a main body portion, wherein the main body portion includes a heel cup, an arch portion and a forefoot portion, wherein the forefoot portion comprises a front part of the middle layer, a front part of the top layer, a front part of the bottom layer and no part of the base layer, wherein the shape of the arch portion is molded into the base layer prior to adhering the bottom and middle layers thereto, wherein the main body portion includes a border portion that extends at least partially around the base layer, wherein the border portion comprises a border part of the bottom layer, a border part of the middle layer, a border part of the top layer, and no part of the base layer, wherein the border part of the bottom layer is adhered to the border part of the middle layer, and wherein the border part of the middle layer is adhered to the border part of the top layer, wherein the border portion has an outside edge, wherein the main body portion includes a flare portion that extends outwardly from the outside edge of the border portion in a transverse direction and is adjacent the arch portion, wherein the flare portion comprises a flare part of the bottom layer, a flare part of the middle layer, a flare part of the top layer, and no part of the base layer, wherein the flare portion includes a top surface and a bottom surface, wherein the top surface of the top layer is coplanar with the top surface of the flare portion, and wherein the bottom surface of the bottom layer is coplanar with the bottom surface of the flare portion, and wherein the base layer is adapted to be actively molded to the shape of a wearer's foot during use.

* * * * *